US006193877B1

(12) United States Patent
McVicker et al.

(10) Patent No.: US 6,193,877 B1
(45) **Date of Patent: *Feb. 27, 2001**

(54) DESULFURIZATION OF PETROLEUM STREAMS CONTAINING CONDENSED RING HETEROCYCLIC ORGANOSULFUR COMPOUNDS

(75) Inventors: Gary B. McVicker, Califon, NJ (US); William C. Baird, Jr., Baton Rouge, LA (US); James J. Schorfheide, Baton Rouge, LA (US); Michel Daage, Baton Rouge, LA (US); Darryl P. Klein, Baton Rouge, LA (US); Edward S. Ellis, Basking Ridge, NJ (US); David E. W. Vaughan, Flemington, NJ (US); Jingguang Chen, Somerville, NJ (US)

(73) Assignee: Exxon Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/918,640

(22) Filed: Aug. 22, 1997

Related U.S. Application Data

(60) Provisional application No. 60/024,737, filed on Aug. 23, 1996.

(51) Int. Cl.[7] ..... C10G 45/06

(52) U.S. Cl. ..... 208/217; 208/208 R; 208/209; 208/213

(58) Field of Search ..... 208/208 R, 209, 208/213, 217

(56) References Cited

U.S. PATENT DOCUMENTS

| | | | | |
|---|---|---|---|---|
| 2,774,719 | * | 12/1956 | Johanson | 208/216 |
| 3,539,306 | | 11/1970 | Kumura et al. | 23/315 |
| 3,796,792 | | 3/1974 | Miyata et al. | 423/250 |
| 3,879,523 | | 4/1975 | Miyata et al. | 423/250 |
| 4,014,783 | * | 3/1977 | Rausch | 208/255 |
| 4,092,239 | * | 5/1978 | Moser | 208/213 |
| 4,263,020 | | 4/1981 | Eberly | 55/62 |
| 4,313,820 | * | 2/1982 | Farha, Jr. et al. | 203/213 |
| 4,372,842 | * | 2/1983 | Gardner | 208/254 H |
| 4,454,244 | | 6/1984 | Woltermann | 502/208 |
| 4,469,590 | * | 9/1984 | Schucker et al. | 208/143 |
| 4,690,806 | | 9/1987 | Schorfheide | 423/230 |
| 4,755,280 | * | 7/1988 | Hudson et al. | 208/89 |
| 4,827,076 | * | 5/1989 | Kakayeff et al. | 585/737 |
| 4,831,206 | | 5/1989 | Zarchy | 585/737 |
| 4,831,207 | | 5/1989 | O'Keefe et al. | 585/737 |
| 5,011,593 | * | 4/1991 | Ware et al. | 208/213 |
| 5,057,256 | | 10/1991 | Beck | 423/277 |
| 5,185,135 | | 2/1993 | Pillai et al | 423/320 |
| 5,266,188 | * | 11/1993 | Kukes et al. | 208/216 R |
| 5,283,047 | | 2/1994 | Vaughan et al. | 423/713 |
| 5,340,466 | * | 8/1994 | Dai et al. | 208/216 PP |
| 5,401,391 | * | 3/1995 | Collins et al. | 208/208 R |
| 5,423,975 | * | 6/1995 | Sudhakar et al. | 208/216 R |
| 5,441,630 | * | 8/1995 | Dai et al. | 208/216 PP |
| 5,454,933 | * | 10/1995 | Savage et al. | 208/212 |
| 5,503,734 | * | 4/1996 | Fletcher et al. | 208/89 |
| 5,525,211 | * | 6/1996 | Sudhakar et al. | 208/217 |
| 5,543,036 | * | 8/1996 | Chang et al. | 208/189 |
| 5,569,802 | * | 10/1996 | Luken et al. | 585/269 |
| 5,609,752 | * | 3/1997 | Del Rossi et al. | 208/144 |
| 5,611,914 | * | 3/1997 | Prince et al. | 208/217 |
| 5,779,883 | * | 7/1998 | Hearn et al. | 208/213 |
| 5,846,406 | * | 12/1998 | Sudhakar et al. | 208/216 R |
| 5,928,498 | * | 7/1999 | McVicker et al. | 208/213 |

OTHER PUBLICATIONS

A Review of Deep Hydrodesulfurization Catalysis, Vasudevan et al., Catalysis Reviews—Sci. Eng., 38,(2) (1996) 161–188 –No Month.

Deep hydrodesulfurization of diesel fuel: Design of reaction process and catalysts, Mochida et al., Catalysis Today 29 (1996), 185–189 –No Month.

Effect of experimental parameters on the relative reactivity of dibenzothiophene and 4–methyldibenzothiophene, Lamure–Meille et al., Applied Catalysis A: General 131 (1995) 143–157 –1995–No Month.

Hydrodesulfurization of Methyl–Substituted Dibenzothiophenes Catalyzed by Sulfided Co–Mo / y–AL2O3, M. Houalla et al., Journal of Catalysis, 61, (1980), 523–527, –No Month.

Reactivities, Reaction Networks, and Kinetics in High–Pressure Catalytic Hydroprocessing, Girgis and Gates, Ind. Eng. Chem, 30, (1991), 2021–205. –No Month.

Hydrotalcite–Type Anionic Clays: Preparation, Properties and Applications, Cavani et al., Catalysis Today, vol. 11, No. 2, (1991), 173–301 –No Month.

* cited by examiner

*Primary Examiner*—Walter D. Griffin
*Assistant Examiner*—Nadine Preisch
(74) *Attorney, Agent, or Firm*—Henry E. Naylor; Gerard J. Hughes

(57) ABSTRACT

A process for the hydrodesulfurization (HDS) of multiple condensed ring heterocyclic organosulftir compounds found in petroleum and petrochemical streams. HDS is preferably conducted in a mixed bed containing: (a) a Ni-based catalyst on an inorganic refractory support, and (b) a hydrogen sulfide sorbent material. The desulfurized stream can then be passed to further processing, including aromatics saturation and/or ring opening.

9 Claims, No Drawings

DESULFURIZATION OF PETROLEUM STREAMS CONTAINING CONDENSED RING HETEROCYCLIC ORGANOSULFUR COMPOUNDS

This application claims the benefit of U.S. Provisional Application No. 60/024,737 filed Aug. 23, 1996.

FIELD OF THE INVENTION

The present invention relates to a process for the hydrodesulfurization (HDS) of multiple condensed ring heterocyclic organosulfur compounds found in petroleum and petrochemical streams. HDS is preferably conducted in a mixed bed containing: (a) a Ni-based catalyst on an inorganic refractory support, and (b) a hydrogen sulfide sorbent material. The desulfurized stream can then be passed to further processing, including aromatics saturation and/or ring opening.

BACKGROUND OF THE INVENTION

Hydrodesulfurization is one of the fundamental processes of the refining and chemical industries. The removal of feed sulfur by conversion to hydrogen sulfide is typically achieved by reaction with hydrogen over non-noble metal sulfides, especially those of Co/Mo and Ni/Mo, at fairly severe temperatures and pressures to meet product quality specifications, or to supply a desulfurized stream to a subsequent sulfur sensitive process. The latter is a particularly important objective because some processes are carried out over catalysts which are extremely sensitive to poisoning by sulfur. This sulfur sensitivity is sometimes sufficiently acute as to require a substantially sulfur free feed. In other cases environmental considerations and mandates drive product quality specifications to very low sulfur levels.

There is a well established hierarchy in the ease of sulfur removal from the various organosulfur compounds common to refinery and chemical streams. Simple aliphatic, naphthenic, and aromatic mercaptans, sulfides, di- and polysulfides and the like surrender their sulfur more readily than the class of heterocyclic sulfur compounds comprised of thiophene and its higher homologs and analogs. Within the generic thiophenic class, desulfurization reactivity decreases with increasing molecular structure and complexity. While simple thiophenes represent the more labile sulfur types, the other extreme, sometimes referred to as "hard sulfur" or "refractory sulfur," is represented by the derivatives of dibenzothiophene, especially those mono- and di-substituted and condensed ring dibenzothiophenes bearing substituents on the carbons beta to the sulfur atom. These highly refractory sulfur heterocycles resist desulfurization as a consequence of steric inhibition precluding the requisite catalyst-substrate interaction. For this reason these materials survive traditional desulfurization and poison subsequent processes whose operability is dependent upon a sulfur sensitive catalyst. Destruction of these "hard sulfur" types can be accomplished under relatively severe process conditions, but this may prove to be economically undesirable owing to the onset of harmful side reactions leading to feed and/or product degradation. Also, the level of investment and operating costs required to drive the severe process conditions may be too great for the required sulfur specification.

A recent review (M. J. Girgis and B. C. Gates, *Ind. Eng. Chem.*, 1991, 30, 2021) addresses the fate of various thiophenic types at reaction conditions employed industrially, e.g., 340–425° C. (644–799° F.), 825–2550 psig. For dibenzothiophenes the substitution of a methyl group into the 4-position or into the 4- and 6-positions decreases the desulfurization activity by an order of magnitude. These authors state, "These methyl-substituted dibenzothiophenes are now recognized as the organosulfur compounds that are most slowly converted in the HDS of heavy fossil fuels. One of the challenges for future technology is to find catalysts and processes to desulfurize them."

M. Houalla et al, *J Catal.*, 61, 523 (1980) disclose activity debits of 1–10 orders of magnitude for similarly substituted dibenzothiophenes under similar hydrodesulfurization conditions. While the literature addresses methyl substituted dibenzothiophenes, it is apparent that substitution with alkyl substituents greater than methyl , e.g., 4, 6-diethyldibenzothiophene, would intensify the refractory nature of these sulfur compounds. Condensed ring aromatic substituents incorporating the 3,4 and/or 6,7 carbons would exert a comparable negative influence. Similar results are described by Lamure-Meille et al, Applied Catalysis A: General, 131, 143, (1995) based on analogous substrates.

Mochida et al, Catalysis Today, 29, 185 (1996) address the deep desulfurization of diesel fuels from the perspective of process and catalyst designs aimed at the conversion of the refractory sulfur types, which "are hardly desulfurized in the conventional HDS process." These authors optimize their process to a product sulfur level of 0.016 wt. %, which reflects the inability of an idealized system to drive the conversion of the most resistant sulfur molecules to extinction. Vasudevan et al, Catalysis Reviews, 38, 161(1996) in a discussion of deep HDS catalysis report that while Pt and Ir catalysts were initially highly active on refractory sulfur species, both catalysts deactivated with time on oil.

In light of the above, there is a need for a desulfurization/ring-opening process capable of converting feeds bearing the refractory, condensed ring sulfur heterocycles at relatively mild process conditions to streams containing substantially no sulfur. Such streams will not deactivate the ring opening catalyst.

SUMMARY OF THE INVENTION

In accordance with the present invention there is provided a process for the substantially complete desulfurization of a stream selected from petroleum and chemical streams containing condensed ring sulfur heterocyclic compounds, which process comprises contacting said stream with a catalyst system comprised of: (a) a hydrodesulfurization catalyst comprised of an effective amount of Ni on an inorganic refractory support; and (b) a hydrogen sulfide sorbent material; wherein the hydrodesulfurization conditions include temperatures from about 40° C. to 500° C., and pressures from about 100 to 3,000 psig.

In a preferred embodiment of the present invention the hydrodesulfurization catalyst and the hydrogen sulfide sorbent are present in a mixed bed.

In yet another preferred embodiment of the present invention a second catalyst is present having an aromatic saturation function.

In yet another preferred embodiment of the present invention the hydrode-sulfurized feedstream is subjected to a ring opening step.

In still another preferred embodiment of the present invention there is provided a catalyst bed, downstream of, or mixed with, the bed that contains the hydrogen sulfide sorbent.

In another preferred embodiment of the present invention, the hydrogen sulfide sorbent is selected from supported and unsupported metal oxides, spinels, zeolitic based materials, and layered double hydroxides.

DETAILED DESCRIPTION OF THE INVENTION

Feedstocks suitable for being treated by the present invention are those petroleum based feedstocks which contain condensed ring sulfur heterocyclic compounds, as well as other ring compounds, including multi-ring aromatic and naphthenic compounds. Such compounds are typically found in petroleum streams boiling in the distillate range and above. Non-limiting examples of such feeds include diesel fuels, jet fuels, heating oils, and lubes. Such feeds typically have a boiling range from about 150 to about 600° C., preferably from about 175 to about 400° C. It is preferred that the streams first be hydrotreated to reduce sulfur contents, preferably to less than about 1,000 wppm, more preferably less than about 500 wppm, most preferably to less than about 200 wppm, particularly less than about 100 wppm sulfur, ideally to less than about 50 wppm. It is highly desirable for the refiner to upgrade these types of feedstocks by removing as much of the sulfur as possible, as well as to open ring compounds to produce paraffins.

It is well known that so-called "easy" sulfur compounds, such as non-thiophenic sulfur compounds, thiophenes, benzothiophenes, and non-beta dibenzothiophenes can be removed without using severe process conditions. The prior art teaches that substantially more severe conditions are needed to remove the so-called "hard" sulfur compounds, such as condensed ring sulfur heterocyclic compounds which are typically present as 3-ring sulfur compounds, such as beta and di-beta dibenzothiophenes. An example of a typical three ring "hard" sulfur compound found in petroleum streams is 4,6-diethyldibenzothiophene. While the desulfurization process of the present invention is applicable to all sulfur bearing compounds common to petroleum and chemical streams, it is particularly suitable for the desulfurization of the least reactive, most highly refractory sulfur species, particularly the class derived from dibenzothiophenes, and most especially the alkyl, aryl, and condensed ring derivatives of this heterocyclic group, particularly those bearing one or more substituents in the 3-, 4-, 6-, and 7-positions relative to the thiophenic sulfur. The process of the present invention will result in a product stream with substantially no sulfur. For purposes of this invention, the term, "substantially no sulfur", depends upon the overall process being considered, but can be defined as a value less than about 1 wppm, preferably less than about 0.5 wppm, more preferably less than about 0.1 wppm, and most preferably less than about 0.01 wppm as measured by existing, conventional analytical technology. It is important that the sulfur levels be as low as possible because the noble metal ring-opening catalysts are susceptible to deactivation, even at relatively low sulfur levels.

It is also known in the art that ring compounds can be opened by use of noble metal supported catalysts. It has surprisingly been found that streams containing a significant amount of "hard sulfur" can be desulfurized at relatively mild conditions and either simultaneously, or subsequently subjected to ring opening with a noble metal supported catalyst.

Catalysts suitable for use in the present invention are those comprised of Ni on an inorganic refractory support. The Ni will be highly dispersed and substantially uniformly distributed on a refractory inorganic support. Various promoter metals may also be incorporated for purposes of selectivity, activity, and stability improvement. Non-limiting examples of promoter metals which may be used include those selected from the group consisting of Re, Cu, Ag, Au, Sn, Zn, and the like.

Suitable support materials for the catalysts and hydrogen sulfide sorbents of the present invention include inorganic, refractory materials such as alumina, silica, silicon carbide, amorphous and crystalline silica-aluminas, silica-magnesias, aluminophosphates boria, titania, zirconia, and mixtures and cogels thereof. Preferred supports include alumina and the crystalline silica-aluminas, particularly those materials classified as clays or zeolitic materials, and more preferably controlled acidity zeolites, including aluminophosphates, and modified by their manner of synthesis, by the incorporation of acidity moderators, and post-synthesis modifications such as demetallation and silylation. For purposes of this invention particularly desirable zeolitic materials are those crystalline materials having micropores and include conventional zeolitic materials and molecular sieves, including aluminophosphates and suitable derivatives thereof. Such materials also include pillared clays and layered double hydroxides.

The Ni may be loaded onto these supports by conventional techniques known in the art. These include impregnation by incipient wetness, by adsorption from excess impregnating medium, or by ion exchange. The Ni bearing catalysts are typically dried, calcined, and reduced; the latter may either be conducted ex situ or in situ as preferred. The catalysts are not presulfided as the presence of sulfur is not essential to HDS or ASAT activity and activity maintenance. Total metal loading for the catalysts of the present invention will range from 1 to 60 wt. %, preferably 2 to 40 wt. %, more preferably 5 to 30 wt. %, and most preferably 5 to 20 wt. %.

The hydrogen sulfide sorbent of this invention may be selected from several classes of material known to be reactive toward hydrogen sulfide and capable of binding same in either a reversible or irreversible manner. Metal oxides are useful in this capacity and may be employed as the bulk oxides or may be supported on an appropriate support. Representative metal oxides include those of the metals from Groups IA, IIA, IB, IIB, IIIA, IVA, VB, VIB, VIIB, VIII of the Periodic Table of the Elements. Representative elements include Zn, Fe, Ni, Cu, Mo, Co, Mg, Mn, W, K, Na, Ca, Ba, La, V, Ta, Nb, Re, Zr, Cr, Ag, Sn, and the like. The metal oxides may be employed individually or in combination. The preferred metal oxides are those of Ba, K, Ca, Co, Ni, and Cu with Zn. Representative supported metal oxides include ZnO on alumina, CuO on silica, ZnO/CuO on kieselguhr, and the like. Compounds of the Group IA and IIA metals capable of functioning as hydrogen sulfide sorbents include, in addition to the oxides, the hydroxides, alkoxides, and sulfides. These systems are disclosed in the following patents of Baird et al. incorporated herein by reference: U.S. Pat. No. 4,003,823; U.S. Pat. No. 4,007,109; U.S. Pat. No. 4,087,348; U.S. Pat. No. 4,087,349; U.S. Pat. No. 4,119,528; and U.S. Pat. No. 4,127,470.

Spinels represent another class of hydrogen sulfide sorbents useful in this invention. These materials are readily synthesized from the appropriate metal salt, frequently a sulfate, and sodium aluminate under the influence of a third agent like sulfuric acid. Spinels of the transition metals listed above may be utilized as effective, regenerable hydrogen sulfide sorbents; zinc aluminum spinel, as defined in U.S. Pat. No. 4,263,020, incorporated herein by reference, is a preferred spinel for this invention. The sulfur capacity of spinels may be promoted through the addition of one or more additional metals such as Fe or Cu as outlined in U.S. Pat. No. 4,690,806, which is incorporated herein by reference.

Zeolitic materials may serve as hydrogen sulfide sorbents for this invention as detailed in U.S. Pat. No. Pat. Nos. 4,831,206 and -207, which are incorporated herein by reference. These materials share with spinels the ability to function as regenerable hydrogen sulfide sorbents and permit operation of this invention in a mode cycling between sulfur capture and sulfur release in either continuous or batch operation depending upon the process configuration. Zeolitic materials incorporating sulfur active metals by ion exchange are also of value to this invention. Examples include Zn4A, chabazite, and faujasite moderated by the incorporation of zinc phosphate, and transition metal framework substituted zeolites similar to, but not limited to, U.S. Pat. Nos. 5,185,135/6/7, and U.S. Pat. No. 5,283,047, and continuations thereof, all incorporated herein by reference.

Various derivatives of hydrotalcite (often referred to as LDH, layered double hydroxides) exhibit high sulfur capacities and for this reason serve as hydrogen sulfide sorbents for this invention. Specific examples include $Mg_{4.8}Al_{1.2}(OH)_{12}Cl_{1.2}$, $Zn_4Cr_2(OH)_{12}Cl_2$, $Zn_4Al_2(OH)_{12}Cl_2Mg_{4.5}Al_{1.5}(OH)_{12}Cl_{1.5}$, $Zn_4Fe_2(OH)_{12}Cl_2$, and $Mg_4Al_2(OH)_{12}Cl_3$ and may include numerous modified and unmodified synthetic and mineral analogs of these as described in U.S. Pat No. 3,539,306, U.S. Pat. No. 3,796,792, U.S. Pat. No. 3,879,523, and U.S. Pat. No. 4,454,244, and reviewed by Cavani et al. in *Catalysis* Today, Vol. 11, No. 2, pp. 173–301 (1991), all of which are incorporated herein by reference. Particularly active hydrogen sulfide sorbents are LaRoach H-T, $ZnSi_2O_5$ gel, $Zn_4Fe_2(OH)_{12}Cl_2$, and the Fe containing clay, nontronite. A study of several Mg—Al hydrotalcites demonstrated a preference for crystallites less than about 300 Angstroms. Particularly novel are pillared varieties of smectites, kandites, LDHs and silicic acids in which the layered structure is pillared by oxides of Fe, Cr, Ni, Co, and Zn, or such oxides in combination with alumina as demonstrated by, but not limited to, U.S. Pat. No. 4,666,877, U.S. Pat. No. 5,326,734, U.S. Pat. No. 4,665,044/5 and Brindley et al, *Clays And Clay Minerals*, 26, 21 (1978) and *Amer. Mineral*, 64, 830 (1979), all incorporated herein by reference. The high molecular dispersions of the reactive metal make them very effective scavengers for sulfur bearing molecules.

A preferred class of hydrogen sulfide sorbents are those which are regenerable as contrasted to those which bind sulfur irreversibly in a stoichiometric reaction. Hydrogen sulfide sorbents which bind sulfur through physical adsorption are generally regenerable through manipulation of the process temperature, pressure, and/or gas rate so that the sorbent may cycle between adsorption and desorption stages. Representative of such sorbents are zeolitic materials, spinels, meso-. and microporous transition metal oxides, particularly oxides of the fourth period of the Periodic Chart of the Elements.

Hydrogen sulfide sorbents which bind sulfur through a chemisorptive mechanism may also be regenerated by the use of reactive agents through which the sulfur bearing compound is reacted and restored to its initial, active state. Reagents useful for the regeneration of these types of hydrogen sulfide sorbents are air (oxygen), steam, hydrogen, and reducing agents such as carbon and carbon monoxide. The choice of regenerating agent is determined by the initial, active state of the sorbent and by the chemical intermediates arising during the regeneration procedure. Active hydrogen sulfide sorbents regenerable by reaction with oxygen include the oxides of manganese, lanthanum, vanadium, tantalum, niobium, molybdenum, rhenium, zirconium, chromium, and mixtures thereof. Active hydrogen sulfide sorbents regenerable through reaction with steam, either alone or in combination with oxygen, include the oxides of lanthanum, iron, tin, zirconium, titanium, chromium, and mixtures thereof Active hydrogen sulfide sorbents regenerable through the sequential action of hydrogen and oxygen include the oxides of iron, cobalt, nickel, copper, silver, tin, rhenium, molybdenum, and mixtures thereof. Active hydrogen sulfide sorbents regenerable through the action of hydrogen include iron, cobalt, nickel, copper, silver, mercury, tin, and mixtures thereof. In addition all transition metal oxides are regenerable from their corresponding sulfates by reduction with hydrogen, carbon, or carbon monoxide. These regeneration reactions may be facilitated by the inclusion of a catalytic agent that facilitates the oxidation or reduction reaction required to restore the sulfur sorbent to its initial, active condition.

In addition, of particular interest as regenerable hydrogen sulfide sorbents are two classes of materials: zeolitic materials enriched in the alkali metals of Group IA; the high surface area, porous materials represented by zeolite-like structures, nonstoichiometric basic oxides of the transition metals, reviewed in part by Wadsley (Nonstoichiometric Compounds, edited by Mandelkom, Academic Press, 1964) and numerous surfactant templated metal oxide materials analogous to MCM-41 type structures as disclosed in U.S. Pat. No. 5,057,296 incorporated herein by reference.

These regeneration processes operate over a temperature range of 100–700 ° C., preferably 150–600 ° C., and more preferably 200–500 ° C. at pressures comparable to those cited below in the general disclosure of process conditions common to this invention.

If the hydrodesulfurized feedstock of the present invention is subjected to a ring opening step, the ring opening catalyst may contain either a metal function alone or a metal function combined with an acid function. The metal function will be comprised of an effective amount of a noble metal selected from Pt, Pd, Ir, Ru, Rh, and mixtures and polymetallics thereof. Preferred are Ir and Ru and more preferred is Ir. Typically, an effective amount of noble metal would be up to about 10 wt. %, based on the total weight of the catalyst. Preferably the amount of metal would be from about 0.01 wt. % to about 5 wt. %, more preferably from about 0.02 wt. % to 3 wt. %, and most preferably from about 0.1 wt. % to 1 wt. %. If used, the precise amount of acidity to balance ring isomerization versus the cracking of feed and product molecules depends on many factors, such as the molecular make-up of the feed, the process conditions, and the particular catalyst employed. Ring opening catalysts useful to this invention are disclosed in U.S. Ser. No. 08/523,300, filed Sep. 5, 1995; and U.S. Ser. No. 08/631,472, filed Apr. 12, 1996; and incorporated herein by reference.

Ring opening will impact the fuel characteristics of these feedstocks by reducing the number of ring structures in the product stream and increasing volume swell by lowering the density of the product stream. It is preferred that the ring opening employed herein be selective. For purposes of this invention, selective ring opening means a high propensity for cleavage of a ring bond which results in product molecules having substantially the same number of carbon atoms and one less ring than the original molecule, thus avoiding significant dealkylation of any pendant substituents on rings which will reduce the volume of product in a specified boiling range.

Molecular classes may be ranked in terms of their cetane number for a specific carbon number: normal paraffins have the highest cetane number followed by normal olefins, isoparaffins, and by monocyclic naphthenes. Aromatic molecules, particularly multi-ring aromatics, have the lowest cetane numbers. For example, naphthalene has a cetane blending number of about 5–10; tetrahydronaphthalene (tetralin) about 15, decahydronaphthalene (decalin) about 35–38, butylcyclohexane about 58–62, and decane about 72–76. These cetane measurements are consistent with the trend for higher cetane value with increasing ring saturation and ring opening.

Since the Ni-based HDS catalyst used in conjunction with the hydrogen sulfide sorbent can simultaneously provide an ASAT function, the Ni-based HDS catalyst will hereinafter be referred to as a Ni-based HDS/ASAT catalyst.

Various catalyst bed configurations may be used in the practice of the present invention with the understanding that the selection of a specific configuration is tied to specific process objectives. A bed configuration where the hydrogen sulfide sorbent is placed upstream of the HDS catalyst is not a configuration of the present invention. Likewise, a bed configuration wherein the Ni-based catalyst is placed upstream of the hydrogen sulfide sorbent is not a configuration of the present invention. Further, a ring opening catalyst placed upstream of the hydrogen sulfide sorbent is also not a configuration of the present invention. The Ni-based catalyst must be used in a mixed bed with the hydrogen sulfide sorbent. A ring opening catalyst can then be used downstream of the mixed bed of Ni-based catalyst and hydrogen sulfide sorbent A preferred configuration is identified as a mixed bed wherein particles of the Ni based supported catalyst are intimately intermixed with those of the hydrogen sulfide sorbent. If the treated feedstock is to undergo ring opening, then the ring opening catalyst can either occupy the same reactor as the hydrodesulfurization catalyst, but in a downstream zone, or in a separate downstream reactor. A separate reactor is preferred when it is desirable to operate the ring opening step at a substantially different temperature than the Ni-based catalyst/hydrogen sulfide sorbent reactor or to facilitate the replacement of the Ni-based catalyst and/or the hydrogen sulfide sorbent. The catalyst components may share similar or identical shapes and sizes, or the particles of one may differ in shape and/or size from the others. The latter relationship is of potential value should it be desirable to affect a simple physical separation of the bed components upon discharge or reworking.

Another configuration is where the Ni-based catalyst and hydrogen sulfide sorbent components are blended together to form a composite particle. For example, a finely divided, powdered Ni on alumina catalyst is uniformly blended with zinc oxide powder and the mixture formed into a common catalyst particle, or zinc oxide powder is incorporated into the alumina mull mix prior to extrusion, and Ni is impregnated on to the zinc oxide-containing alumina in a manner similar to that described in U.S. Pat. No. 4,963,249, 10/16/90, incorporated herein by reference.

A final configuration is based on the impregnation of a support with a Ni -salt and a hydrogen sulfide sorbent-active salt (e.g., Zn) to prepare a bimetallic catalyst incorporating Ni and the hydrogen sulfide sorbent on a common base. For example, a Ni—Zn bimetallic may be prepared in such a manner as to distribute both metals uniformly throughout the extrudate, or, alternatively, the Zn component may be deposited preferentially in the exterior region of the extrudate to produce a rim, or eggshell, Zn rich zone, or the Ni component may be deposited preferentially in the exterior region of the extrudate to produce a rim, or eggshell, Ni rich zone. This catalyst would then be followed by the ring opening catalyst, either occupying a common reactor or a separate reactor downstream. A separate reactor is preferred when it is desirable to operate the ring opening catalyst at a substantially different temperature than the HDS/ASAT/hydrogen sulfide sorbent catalyst.

In general, the weight ratio of the hydrogen sulfide sorbent to the Ni-based catalyst may range from 0.01 to 1000, preferably from 0.5 to 40, and more preferably from 0.7 to 30. For three component configurations the ranges cited apply to the mixed zone of the mixed/stacked arrangement and to the first two zones of the stacked/stacked/stacked design. The Ni-based catalyst present in the final zone of these two arrays is generally present at a weight ratio equal to, or less than, the combined weight compositions of the upstream zones.

The process of this invention is operable over a range of conditions consistent with the intended objectives in terms of product quality improvement. It is understood that hydrogen is an essential component of the process and may be supplied pure or admixed with other passive or inert gases as is frequently the case in a refining or chemical processing environment. It is preferred that the hydrogen stream be sulfur-free, or essentially sulfur-free, and it is understood that the latter condition may be achieved if desired by conventional technologies currently utilized for this purpose. In general, the conditions of temperature and pressure are significantly mild relative to conventional hydroprocessing technology, especially with regard to the processing of streams containing the refractory sulfur types as herein previously defined. This invention is commonly operated at a temperature of 40–500 ° C. (104–932 ° F.) and preferably 225–400 ° C. (437–752 ° F.). Operating pressure includes 100–3,000 psig, preferably 100–2,200 psig, and more preferably 100–1,000 psig at gas rates of 50–10,000 SCF/B (standard cubic feet per barrel), preferably 100–7,500 SCF/B, and more preferably 500–5,000 SCF/B. The feed rate may be varied over the range 0.1–100 LHSV (liquid hourly space velocity), preferably 0.3–40 LHSV, and more preferably 0.5–30 LHSV.

The composition of the sorbent bed is independent of configuration and may be varied with respect to the specific process, or integrated process, to which this invention is applied. In those instances where the capacity of the hydrogen sulfide sorbent is limiting, the composition of the sorbent bed must be consistent with the expected lifetime, or cycle, of the process. These parameters are in turn sensitive to the sulfur content of the feed being processed and to the degree of desulftirization desired. For these reasons, the composition of the guard bed is flexible and variable, and the optimal bed composition for one application may not serve an alternative application equally well. In general, the weight ratio of the hydrogen sulfide sorbent to the hydrodesulfurization catalyst may range from 0.01 to 1000, preferably from 0.5 to 40, and more preferably from 0.7 to 30. For three component configurations the ranges cited apply to the mixed zone of the mixed/stacked arrangement and to the first two zones of the stacked/stacked/stacked design. The hydrodesulfurization catalyst present in the final zone of these two arrays is generally present at a weight equal to, or less than, the combined weight compositions of the upstream zones.

This invention is illustrated by, but not limited to, the following examples.

EXAMPLE 1

A mixed sulfur guard bed was prepared by blending 1 g of a 15 wt. % Ni on alumina catalyst, prepared by impregnating alumina with a standardized solution of nickel nitrate, with 2 g of zinc oxide. This mixture was layered above a 2 g bed of a 0.9 wt. % Ir ring opening catalyst, which was prepared by impregnating alumina with a standardized solution of chloroiridic acid, to provide a mixed/stacked configuration. This system was evaluated for the ring opening of methylcyclohexane containing 5 wppm sulfur as thiophene and 10 wppm sulfur as 4,6-diethyldibenzothiophene. The results of this experiment appear in Table 1. The results demonstrate that the mixed guard bed upstream of the ring opening catalyst protected the latter from deactivation by sulfur poisoning. This example shows that the system of the present invention is capable of desulfurizing a feed rich in a refractory sulfur compound under mild hydrodesulfurization conditions.

EXAMPLE 2

The procedure of Example 1 was followed to prepare a mixed/stacked catalyst bed comprising 15 wt. % Ni on alumina commingled with zinc oxide upstream of the Ir ring opening catalyst. This system was evaluated for the ring opening of methylcyclohexane containing 50 wppm sulfur as 4,6-diethyldibenzothiophene. The results in Table 1 establish the retention of stable ring opening activity for an extended period of operation on this sulfur rich feed and on this highly refractory sulfur compound, which is being hydrodesulfurized over a noble metal catalyst at mild conditions.

EXAMPLE 3 (Comparative)

The procedure of Example 2 was followed using the 15 wt. % Ni catalyst of Example 1 in the stacked guard bed configuration. The results are presented in Table 1. Comparison of Examples 2 and 3 reveal stable activity in Example 2 and immediate deactivation in Example 3. The results reinforce the dependency of the Ni-based catalyst of the present invention on bed configuration.

TABLE 1

Ring Opening Of Methylcyclohexane Containing 15 and 50 wppm Sulfur As Thiophene and 4,6-Diethyldibenzothiophene
Methylcyclohexane, 275° C., 400 psig, 7.7 W/H/W, $H_2$/Oil = 6

| | | Conversion, Wt. % @ Hr On Oil | | | Ring Opening Rate[1] @ Hr On Oil | | |
|---|---|---|---|---|---|---|---|
| Example | Catalyst | 50 | 100 | 250 | 50 | 100 | 250 |
| 1(15 ppm S) | Ni + ZnO/Ir | 11.6 | 11.4 | 10.7 | 8.0 | 7.8 | 7.4 |
| 2(50 ppm S) | Ni + ZnO/Ir | 18.1 | 17.5 | — | 12.5 | 12.1 | — |
| 3(50 ppm S) | Ni/ZnO/Ir | 0.0 | — | — | 0.0 | — | — |

[1]Ring Opening Rate = mol./g./hr.

What is claimed is:

1. A process for the substantially complete desulfurization of a stream selected from petroleum and chemical streams containing condensed ring sulfur heterocyclic compounds, which process comprises contacting said stream with a catalyst system comprising a mixed bed of: (a) a calcined and reduced hydrodesulfurization catalyst consisting essentially of an effective amount of Ni on an inorganic refractory support; and (b) a hydrogen sulfide sorbent material selected from the group consisting of spinels and layered double hydroxides wherein the hydrodesulfurization conditions include temperatures from about 40° C. to 500° C., and pressures from about 100 to 3,000 psig.

2. The process of claim 1 wherein a second catalyst is present which has an aromatic saturation function.

3. The process of claim 1 wherein the inorganic refractory support is selected from the group consisting of oxides of Al, Si, Mg, B, Ti, Zr, P, and mixtures and cogels thereof.

4. The process of claim 2 wherein the stream contains ring compounds and is subject to a ring opening step.

5. The process of claim 4 wherein the ring opening step is conducted in the presence of a catalyst comprised of a noble metal selected from the group consisting of Pt, Pd, Ir, Ru, and Rh on an inorganic refractory support, at ring opening conditions which include temperatures of 225° C. to about 400° C., and a total pressure of about 100 to 2,200 psig.

6. The process of claim 1 wherein the hydrogen sulfide sorbent is an oxide of a metal selected from the group consisting of K, Ba, Ca, Zn, Co, Ni, and Cu.

7. The process of claim 1 wherein the amount of Ni in the hydrodesulfurization catalyst is up to about 30 wt. %, based on the total weight of the catalyst.

8. The process of claim 5 wherein the pressure is from about 100 to 1,000 psig.

9. The process of claim 1 wherein the hydrodesulfurization catalyst and the hydrogen sulfide sorbent material are composited into particles, each of with contains both the catalyst and the hydrogen sulfide sorbent material.

* * * * *